US008668481B2

(12) United States Patent
Gabrielli

(10) Patent No.: US 8,668,481 B2
(45) Date of Patent: Mar. 11, 2014

(54) PUMP ASSEMBLY, IN PARTICULAR FOR HELICOPTER LUBRICATION

(75) Inventor: Andrea Gabrielli, Samarate (IT)

(73) Assignee: Agustawestland S.p.A., Samarate (IT)

( * ) Notice: Subject to any disclaimer, the term of this patent is extended or adjusted under 35 U.S.C. 154(b) by 167 days.

(21) Appl. No.: 13/267,630

(22) Filed: Oct. 6, 2011

(65) Prior Publication Data

US 2012/0087821 A1 Apr. 12, 2012

(30) Foreign Application Priority Data

Oct. 6, 2010 (EP) ..... 10425326

(51) Int. Cl.
*F01C 1/08* (2006.01)

(52) U.S. Cl.
USPC ..... 418/166

(58) Field of Classification Search
USPC ..... 418/5, 9, 7, 40, 69, 61.3, 215, 210, 209, 418/199, 166, 164, 161, 160, 150
See application file for complete search history.

(56) References Cited

U.S. PATENT DOCUMENTS

| | | | | |
|---|---|---|---|---|
| 2,481,047 | A * | 9/1949 | Sloane | 418/199 |
| 2,497,373 | A * | 2/1950 | Richards, Jr. | 418/7 |
| 2,665,638 | A * | 1/1954 | Lauck | 418/69 |
| 2,694,978 | A * | 11/1954 | Berry | 418/7 |
| 2,713,309 | A * | 7/1955 | Berry | 418/7 |
| 2,750,891 | A * | 6/1956 | Berry | 418/7 |
| 2,835,229 | A * | 5/1958 | Richards | 418/7 |
| 3,272,130 | A * | 9/1966 | Mosbacher | 418/9 |
| 3,394,925 | A * | 7/1968 | Sluijters | 366/181.8 |
| 3,396,632 | A * | 8/1968 | Leblanc | 418/36 |
| 3,726,615 | A * | 4/1973 | Kolinski | 418/7 |
| 3,756,753 | A * | 9/1973 | Persson et al. | 418/9 |
| 4,068,984 | A * | 1/1978 | Spindler | 418/9 |
| 4,392,798 | A * | 7/1983 | Bowden | 418/102 |
| 4,553,914 | A * | 11/1985 | Noell et al. | 418/69 |
| 4,940,394 | A * | 7/1990 | Gibbons | 417/283 |
| 4,976,669 | A * | 12/1990 | Jones | 475/248 |
| 5,101,782 | A * | 4/1992 | Yang | 123/204 |
| 5,674,063 | A * | 10/1997 | Ozaki et al. | 418/201.3 |
| 5,797,734 | A * | 8/1998 | Kizer et al. | 418/9 |
| 5,846,066 | A * | 12/1998 | Troup | 418/3 |
| 6,314,934 | B1 | 11/2001 | Ito et al. | |
| 7,074,026 | B2 * | 7/2006 | Graber, Jr. | 418/202 |
| 2003/0223896 | A1 * | 12/2003 | Gilbert et al. | 418/9 |

FOREIGN PATENT DOCUMENTS

| | | | |
|---|---|---|---|
| EP | 1 657 442 | A2 | 5/2006 |
| EP | 2 085 616 | A1 | 8/2009 |
| FR | 2 830 290 | A1 | 4/2003 |
| JP | 2001 073731 | A1 | 3/2001 |
| WO | 2005/068945 | A1 | 7/2005 |
| WO | 2008/062486 | A1 | 5/2008 |

OTHER PUBLICATIONS

European Search Report dated Mar. 17, 2011 for EP 10425326.

* cited by examiner

*Primary Examiner* — Kenneth Bomberg
*Assistant Examiner* — Jason T. Newton
(74) *Attorney, Agent, or Firm* — McDonnell Boehnen Hulbert & Berghoff LLP

(57) ABSTRACT

A pump assembly, in particular for lubrication in helicopters, has a casing, the lateral wall of which defines an intake port and a delivery port; and the casing houses two rotary pumps powered by a drive shaft via a motion-splitting transmission.

12 Claims, 5 Drawing Sheets

PUMP ASSEMBLY, IN PARTICULAR FOR HELICOPTER LUBRICATION

CROSS REFERENCE TO RELATED APPLICATION

This application claims the benefit of European Patent Application No. 10425326.5, filed on Oct. 6, 2010, which is hereby incorporated herein by reference in its entirety.

BACKGROUND OF THE INVENTION

As is known, commonly used helicopter transmission lubricating pumps have a drive shaft fitted with a gear that meshes with a gear in the transmission. The most common arrangement is what is known as a "cartridge", i.e. the pump is housed partly inside a cylindrical seat coaxial with the drive shaft and formed in a housing, which has two sections on opposite sides of the pump and connected to the lubricating circuit intake and delivery pipes respectively.

Since relatively little power is normally demanded of the pump, torque transmitted to the drive shaft is also relatively low, so the drive shaft can simply be supported by bushings, with no need for rolling bearings.

The seat in the housing must be wide enough to permit passage of the drive shaft and its gear, the size of which is inversely proportional to the required rotation speed of the drive shaft.

In helicopter transmissions, rotation speeds are relatively high, so volumetric efficiency is low. That is, the pumping chambers rarely manage to fill completely, because of the short length of time they remain connected to the intake section. Moreover, excessive rotation speed may cause cavitation phenomena, resulting in rapid wear and unreliability of the pump.

SUMMARY OF THE INVENTION

It is an object of the present invention to provide a pump assembly, in particular for helicopter lubrication, designed to provide a simple, low-cost solution to the above drawbacks.

According to the present invention, there is provided a pump assembly, in particular for lubrication in helicopters, comprising:

a drive shaft extending along a longitudinal axis;

a casing comprising:

a) a lateral wall defining an intake port and a delivery port;

b) a rear wall and front wall opposite each other and crosswise to said longitudinal axis;

pumping means housed in said casing;

the pump assembly being characterized in that said pumping means comprise two rotary pumps; and by comprising a transmission that divides the power of said drive shaft between said rotary pumps.

BRIEF DESCRIPTION OF THE DRAWINGS

A preferred non-limiting embodiment of the present invention will be described by way of example with reference to the accompanying drawings, in which.

DETAILED DESCRIPTION OF THE INVENTION

Figure 1:
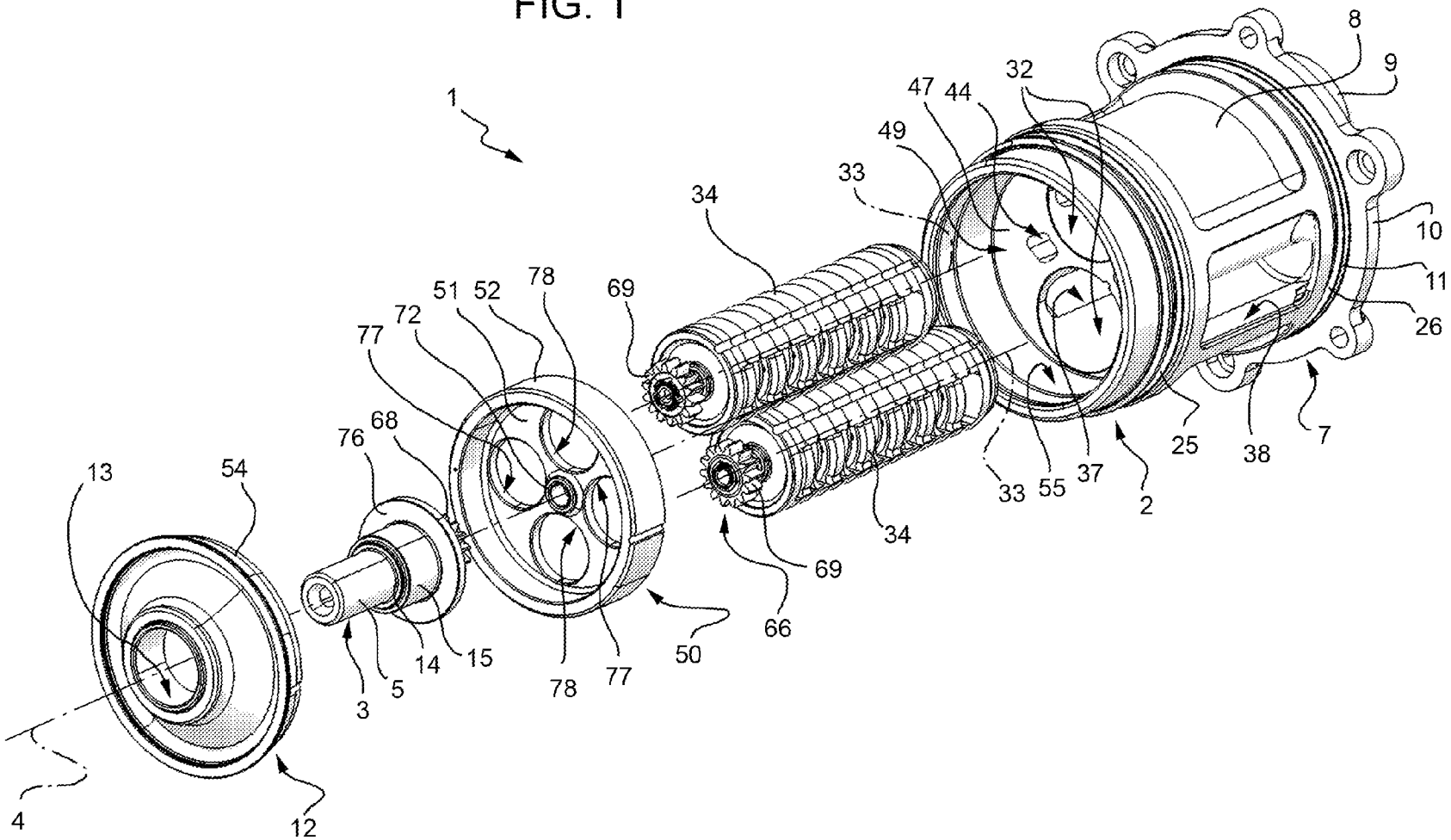
FIG. 1 shows an exploded view of a preferred embodiment of the pump assembly, in particular for helicopter lubrication, according to the present invention.

Number 1 in FIG. 1 indicates a pump assembly comprising a casing 2; and a drive shaft 3 extending along an axis 4 and terminating axially with a portion 5 outside casing 2.

Casing 2 comprises a hollow body 7 cast in one piece and in turn comprising a substantially cylindrical lateral wall 8, a rear wall 9 perpendicular to axis 4, and a flange 10 projecting from an end portion 11 of lateral wall 8. Casing 2 also comprises a plate 12 opposite rear wall 9, and which closes hollow body 7 axially, and has an axial hole 13 engaged by an intermediate portion 14 of shaft 3, with the interposition of a sliding bearing 15.

Figure 2:
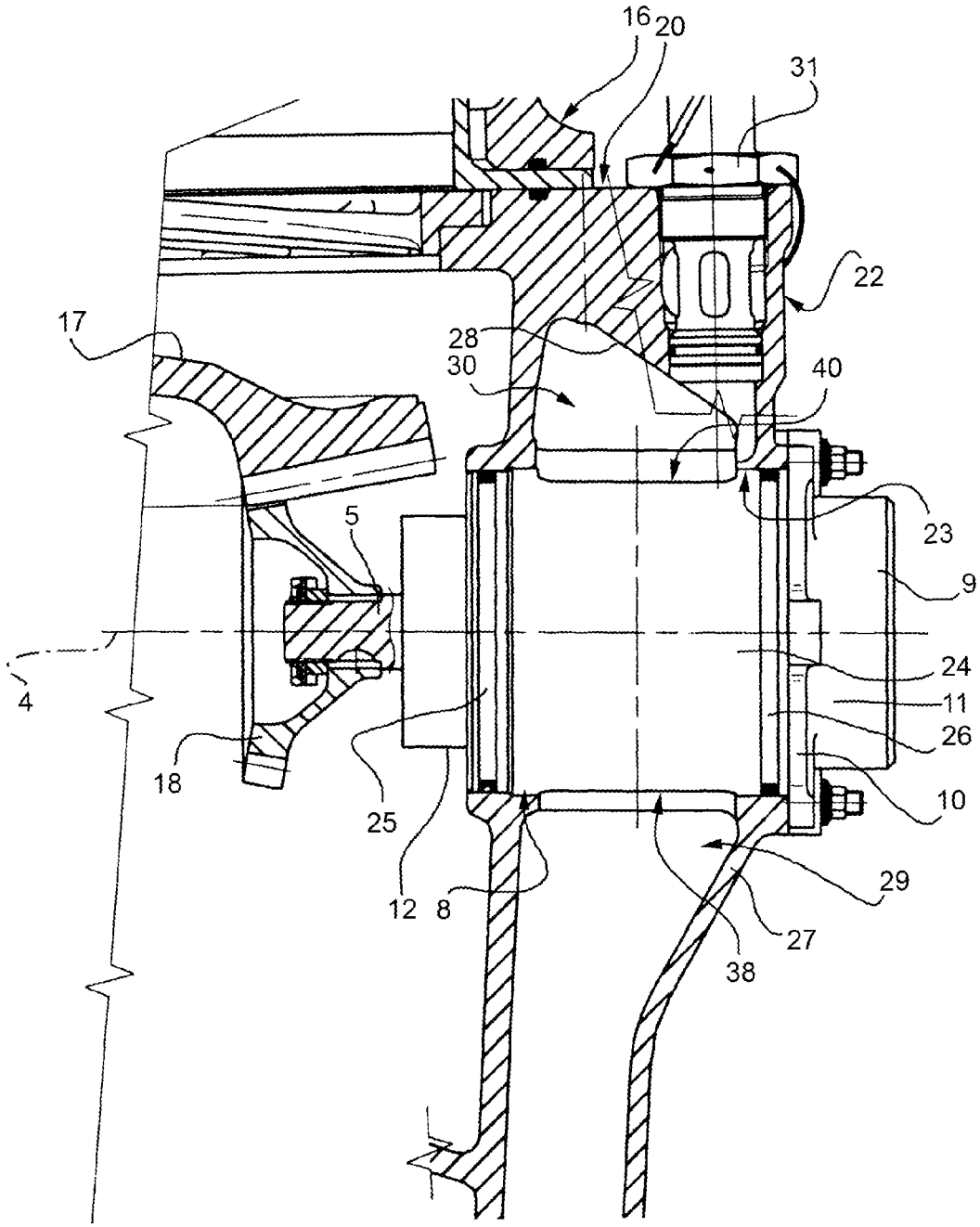
FIG. 2 shows a section of the FIG. 1 pump assembly installed on a helicopter shown partly in section.

With reference to FIG. 2, pump assembly 1 may be used to advantage for lubricating a helicopter 16 (shown partly) comprising: a transmission 17 (shown partly) which rotates a gear 18 fitted in a fixed position to portion 5; and a box 20 (shown partly) enclosing transmission 17 and comprising a housing 22. Housing 22 has a substantially cylindrical seat 23 coaxial with shaft 3 and engaged by a portion 24 of lateral wall 8. The axial ends 25, 26 of portion 24 are adjacent to plate 12 and flange 10 respectively, and are connected to housing 22 with the interposition of respective sealing rings. Flange 10, together with portion 11 and rear wall 9, is located outside housing 22, at the opposite axial end from transmission 17 and portion 5, and is fixed to housing 22, e.g. by screws.

Housing 22 comprises two sections 27, 28 diametrically opposite with respect to seat 23, and which define an intake channel 29 from a tank, and s delivery section 30 respectively. Intake channel 29 and delivery section 30 are isolated from each other by portion 24; and sections 27, 28 are connected to respective pipes 31 (only one shown in FIG. 2) forming part of the lubricating circuit.

Figure 3:
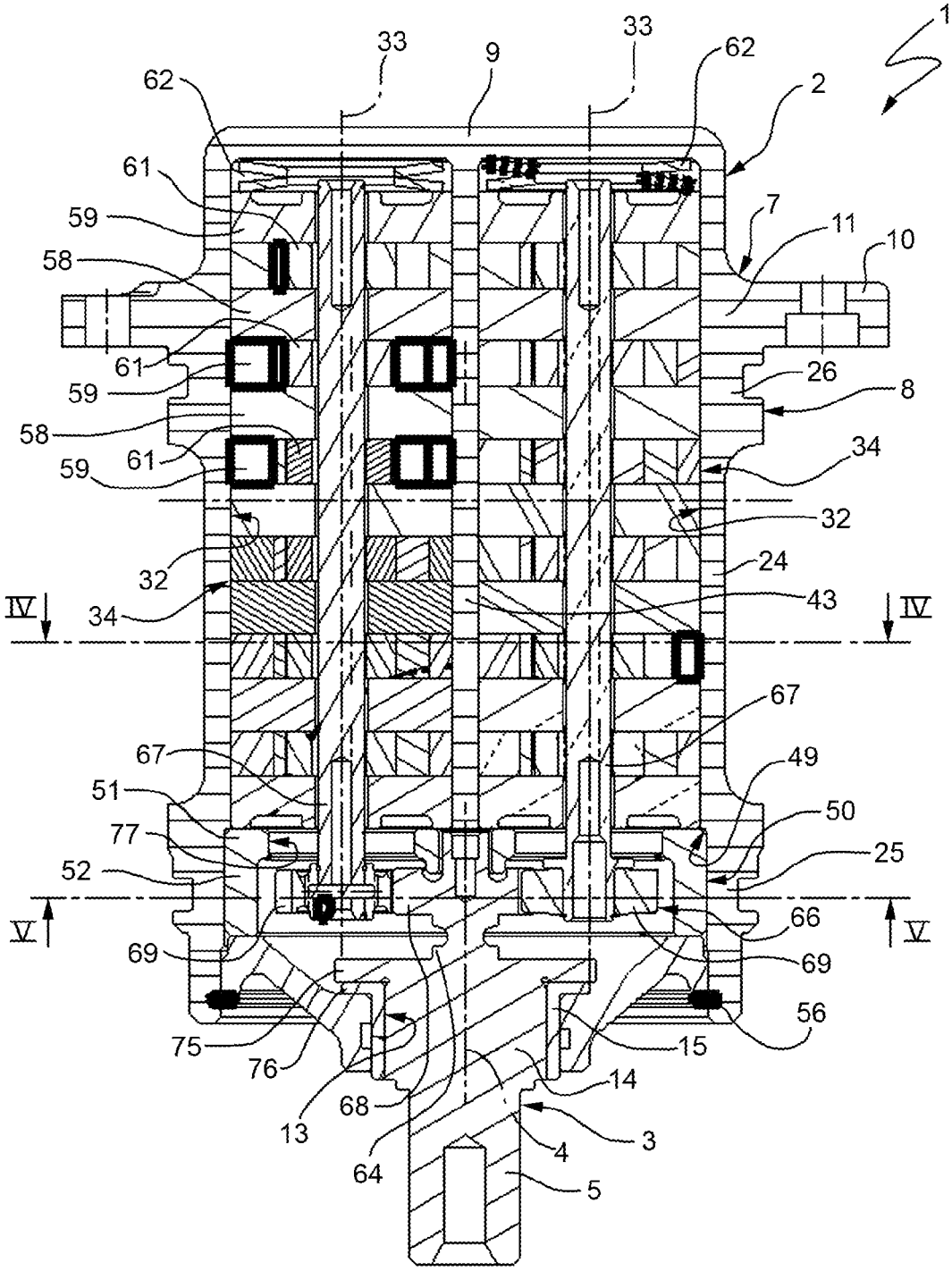
FIG. 3 shows a cross section of the FIG. 1 pump assembly.
Figure 4:
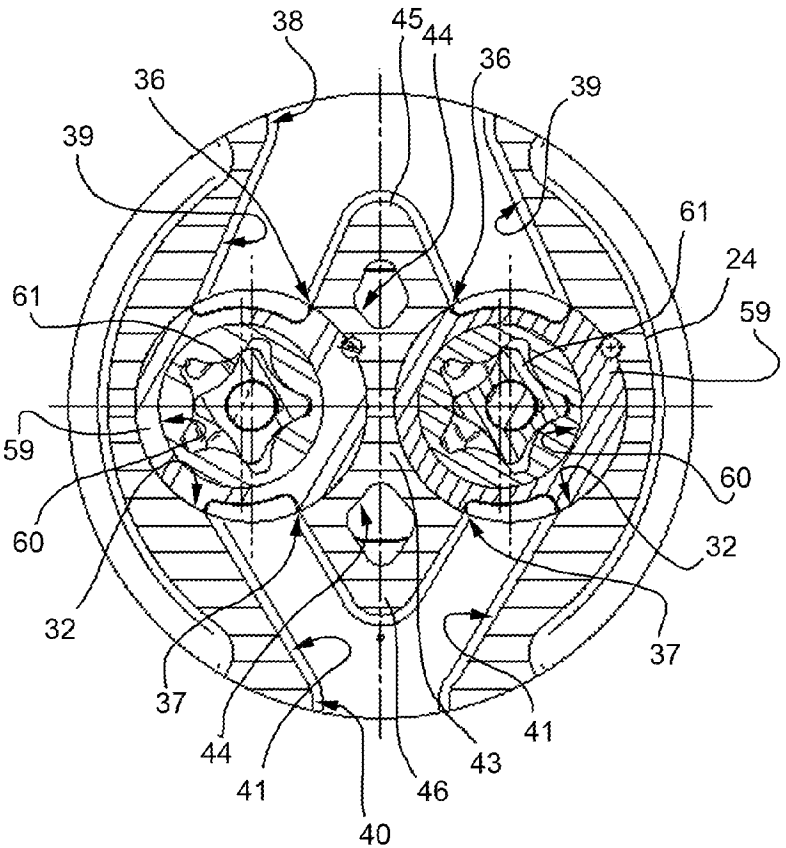

With reference to FIGS. 1 and 3, hollow body 7 has two diametrically opposite inner seats 32, which extend along respective axes 33 parallel to axis 4, are bounded axially by rear wall 9, house respective rotary, preferably gerotor, pumps 34, and each have a radial inlet 36 and a radial outlet 37. Portion 24 has two diametrically opposite openings, which respectively define an intake port 38 communicating with inlets 36 along respective passages 39, and a delivery port 40 communicating with outlets 37 along respective passages 41. As shown in FIG. 4, hollow body 7 comprises a partition wall 43 which extends along axis 4, separates seats 32 radially, and has two inner holes 44 parallel to axis 4. The diametrically opposite ends of partition wall 43 are defined by rounded tips 45, 46 separating passages 39 and passages 41 respectively. More specifically, tip 45 divides the fluid flow drawn by intake channel 29 through port 38 into equal parts.

Passages 39, 41 and the other openings in hollow body 7 are designed geometrically to avoid sharp constrictions and changes in direction, which would result in concentrated load losses and, hence, reduced efficiency.

As shown in FIGS. 1 and 3, partition wall 43 originates at rear wall 9 and terminates in an intermediate wall 47 of hollow body 7, through which seats 32 and holes 44 exit. Wall 47 axially defines passages 39, 41 on one side, and an end compartment 49 of hollow body 7 on the other. Compartment 49 is cylindrical, is closed axially by plate 12, and houses a cup-shaped body 50 comprising a disk 51 defining a calibrated spacer for adjusting the preload of springs 62 described below. Disk 51 is perpendicular to axis 4 and rests axially against wall 47.

Figure 7:
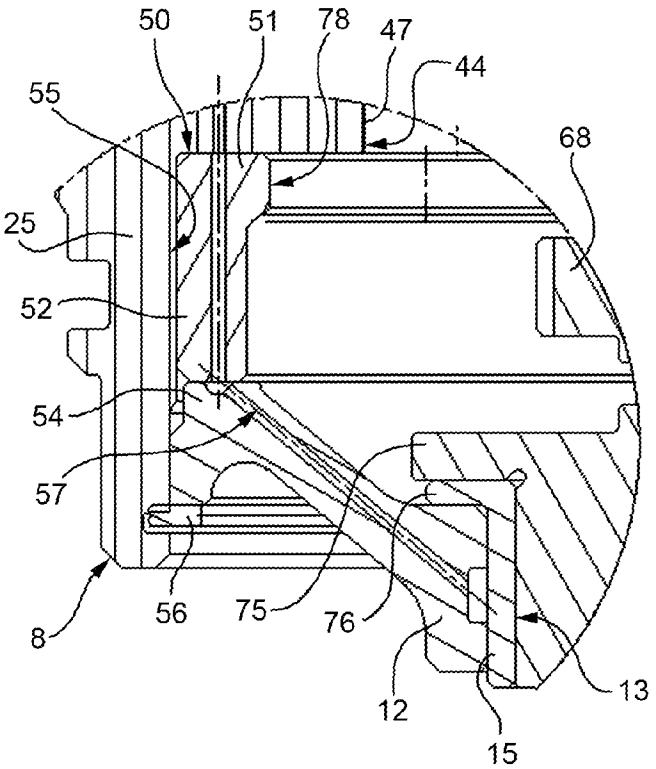
FIG. 7 shows a larger-scale section of a further detail of the pump assembly.

With reference to FIG. 7, body 50 also comprises a cylindrical collar 52 which projects from the edge of disk 51 towards a peripheral portion 54 of plate 12, and is connected in a fixed angular position to a cylindrical inner surface 55 of portion 24 at axial end 25. Portion 54 is also connected in a fixed angular position to surface 55, and is held resting axially against the edge of collar 52 by a ring 56 fixed to the end of lateral wall 8. Hole 13 is connected to port 40 by a conduit 57 comprising three aligned portions formed respectively in wall 47, collar 52, and plate 12, to lubricate bearing 15.

With reference to FIGS. 3 and 4, the two pumps 34 comprise respective numbers of angularly fixed, alternating disk members 58, 59. Members 58 define the inlets and outlets of pumps 34; and members 59 define respective eccentric circular seats 60 engaged by rotors 61. Belleville springs 62 of pumps 34 are housed in seats 32, between pumps 34 and rear wall 9, and are preloaded to push pumps 34 axially against disk 51 and counteract axial detachment of members 58, 59 by the oil pressure in the outlets.

Figure 5:
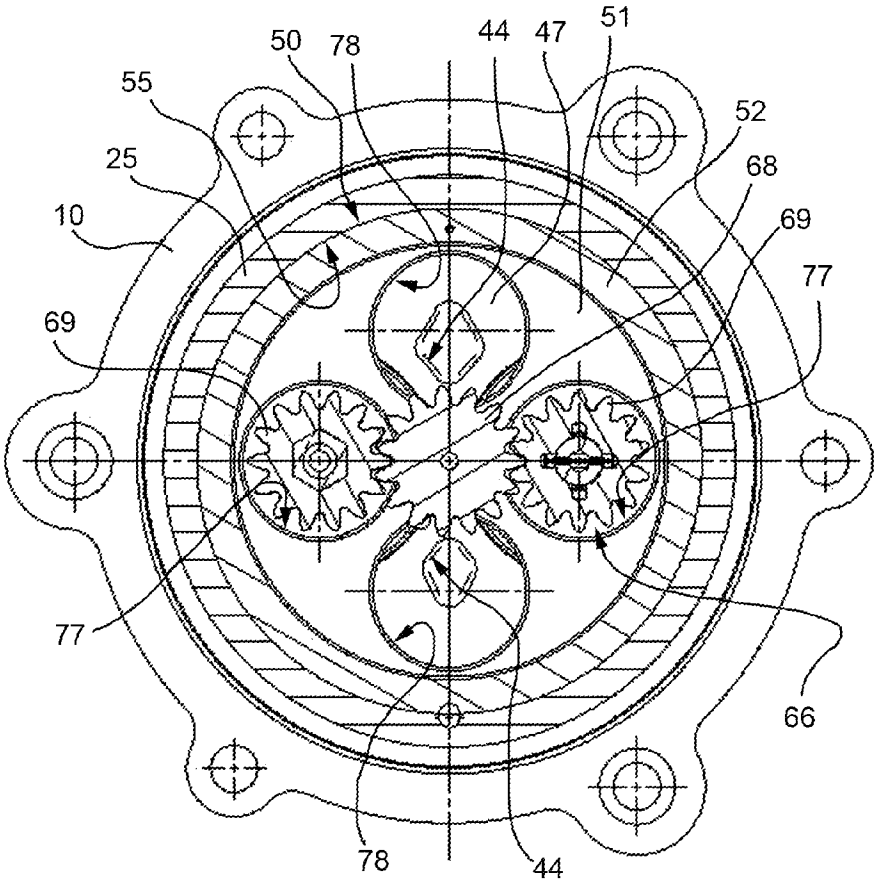
FIGS. 4 and 5 show sections along lines IV-IV and V-V in FIG. 3.
Figure 6:
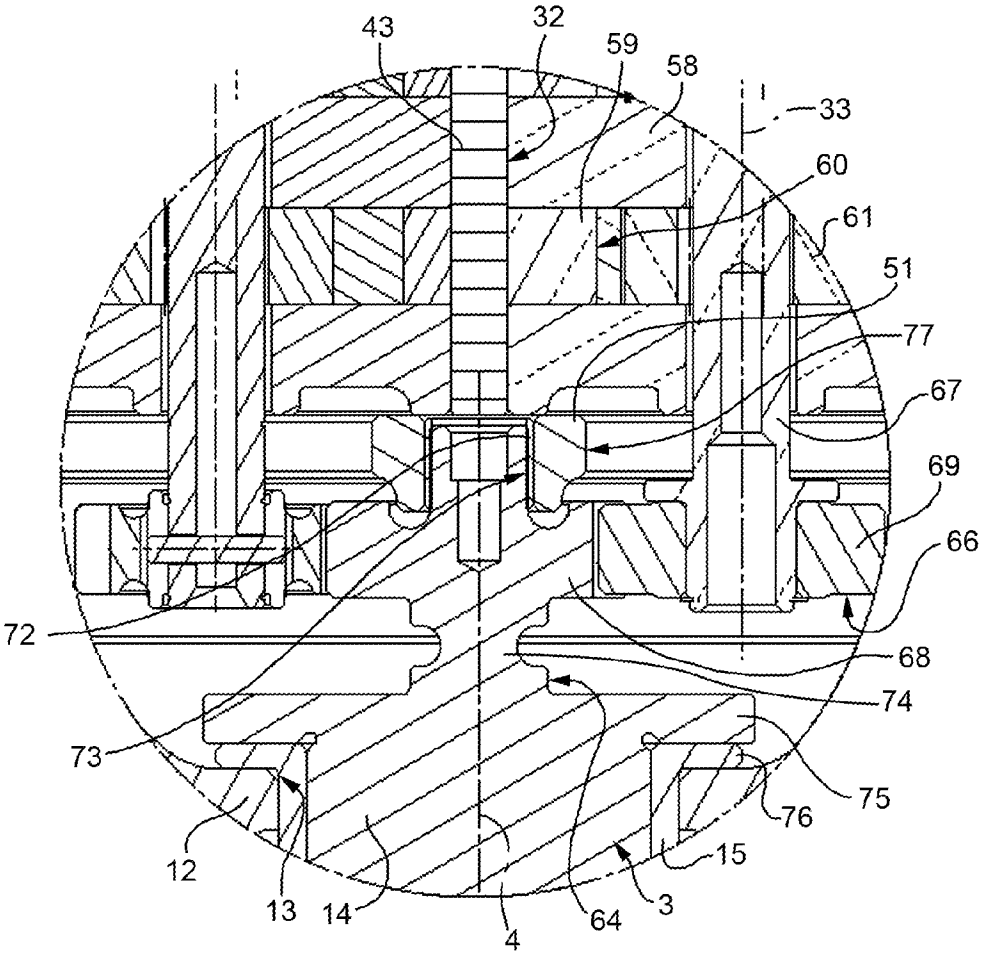
FIG. 6 shows an enlarged detail of FIG. 3.

With reference to FIG. 6, compartment 49 houses: a portion 64 of shaft 3 opposite portion 5; and a gear transmission 66 which transmits power from portion 64 to two shafts 67 coaxial with seats 32 and connected to rotors 61 to rotate them. Transmission 66 divides the drive torque equally between pumps 34, and comprises a gear 68 fixed with respect to portion 64; and two driven gears 69 which mesh with gear 68, therefore rotate in the same direction, and are fitted in fixed positions to respective shafts 67. FIG. 5 shows two alternative ways of fitting gears 69 angularly to shafts 67, i.e. by means of a hexagonal seat or radial pin.

According to a preferred aspect of the invention, transmission 66 is a speed reducer. And the component part dimensions of pumps 34 and the velocity ratio of transmission 66 are designed to keep the tip speed of rotors 61 below a critical threshold that would result in cavitation phenomena.

As shown in FIG. 6, gear 68 and portion 64 are preferably formed in one piece, and the axial end of portion 64 is supported by disk 51. More specifically, a sliding bearing 72 engages a seat 73 formed in disk 51, and is interposed between disk 51 and the axial end of portion 64.

Between gear 68 and portion 5, shaft 3 conveniently comprises a weak portion 74 defined, for example, by a narrower cross section of portion 64 and designed to yield when the power draw of pump assembly 1 exceeds a maximum threshold. And, between portions 74 and 14, portion 64 comprises a flange 75 which rests axially on plate 12, with the interposition of an end flange 76 of bearing 15, to prevent withdrawal of shaft 3 through hole 13.

With reference to FIGS. 1 and 5, disk 51 has two through holes 77 coaxial with gears 69 and fitted through with shafts 67. Holes 77 are smaller than seats 32, so that disk 51 closes seats 32 partly, and are larger than gears 69, so disk 51 can be fitted over gears 69 into compartment 49 when assembling pump assembly 1. Disk 51 also has two weight-reducing holes 78 spaced 90° apart from holes 77.

For a given size of casing 2, two smaller parallel pumps 34 are therefore provided, as opposed to one pump powered by shaft 3.

All other conditions imposed by the transmission box of helicopter 16 (tip speed and maximum size of gear 18, size of casing 2, etc.) being the same, the best compromise between the velocity ratio of transmission 66 and the component part dimensions of pumps 34 can therefore be established at the design stage, to achieve relatively high volumetric efficiency and safeguard against cavitation.

Transmission 66 therefore performs a motion-splitting function, as well as enabling rotation adjustment of rotors 61 at the design stage.

The construction design of hollow body 7 makes pump assembly 1 relatively easy to assemble, and reduces the number of component parts, while maintaining the same external dimensions imposed by the transmission box of helicopter 16.

Other advantages will be clear from the above description.

Clearly, changes may be made to pump assembly 1 as described and illustrated herein without, however, departing from the scope of the present invention as defined in the accompanying claims.

In particular, pumps 34 may be other than gerotor types, e.g. vane pumps; and/or pumps 34 may be positioned axially inside hollow body 7 by systems other than springs 62 and disk 51; and/or hollow body 7 may comprise a number of connected parts, as opposed to a one-piece casting; and/or transmission 66 may be a toothed belt type, and/or may be located outside hollow body 7 if there is enough space between transmission 17 and housing 22.

The invention claimed is:

1. A pump assembly (1), in particular for lubrication in helicopters (16), comprising :

a drive shaft (3) extending along a longitudinal axis (4);

a casing (2) comprising :

a) a lateral wall (8) defining an intake port (38) and a delivery port (40);

b) a rear wall (9) and front wall (12) opposite each other and crosswise to said longitudinal axis (4), said front wall (12) having an axial hole (13) fitted through with said drive shaft (3);

pumping means (34) housed in said casing (2), said pumping means comprising two rotary pumps (34);

a transmission (66) that splits the motion of said drive shaft (3) between said rotary pumps (34), wherein said transmission (66) is housed in a compartment (49) of said casing (2) and comprises two driven gears (69) respectively operating said rotary pumps (34); and a disk (51) housed in a fixed position in said compartment (49) coaxially with said drive shaft (3), wherein said disk (51) supports an axial end of said drive shaft (3) and has two through holes (77) aligned with and larger than said driven gears (69).

2. A pump assembly as claimed in claim 1, wherein said rotary pumps (34) extend along respective axes (33) parallel to said longitudinal axis (4), and are diametrically opposite.

3. A pump assembly as claimed in claim 1, wherein said transmission (66) is a speed reducer.

4. A pump assembly as claimed in claim 1, wherein said transmission (66) comprises a drive gear (68) formed in one piece with said drive shaft (3).

5. A pump assembly as claimed in claim 1, wherein said front wall (12) is a plate axially closing said compartment (49) and connected to said lateral wall (8).

6. A pump assembly as claimed in claim 1, wherein said casing (2) has a lubricating conduit (57) connecting said delivery port (40) to said axial hole (13).

7. A pump assembly as claimed in claim 1, further comprising elastic means (62) which push said rotary pumps (34) axially against said disk (51).

8. A pump assembly as claimed in claim 1, wherein said drive shaft (3) comprises a flange (75) located inside said compartment (49) and resting axially against said front wall (12).

9. A pump assembly as claimed in claim 1, wherein said drive shaft (3) comprises a weak portion (74) in an intermediate axial position between said transmission (66) and an input gear (18).

10. A pump assembly as claimed in claim 9, wherein said weak portion (74) is inside said casing (2).

11. A pump assembly as claimed in claim 1, wherein said lateral wall (8) and said rear wall (9) form part of a hollow body (7) made in one piece and defining internally:

two seats (32) housing said rotary pumps (34), and each having an inlet and an outlet;

two intake passages (39) connecting said intake port (38) to respective said inlets; and two delivery passages (41) connecting said delivery port (40) to respective said outlets.

12. A pump assembly as claimed in claim 1, wherein said rotary pumps (34) are gerotor pumps.

* * * * *